United States Patent [19]

Koch

[11] Patent Number: 4,632,226

[45] Date of Patent: Dec. 30, 1986

[54] ANTI-FALLING DEVICE WITH RAPID INTRODUCTION AND WITHDRAWAL OF THE CORD IN ANY POSITION OF THIS LATTER

[76] Inventor: Albert Koch, "Doux Sejour", 67860 Lutzelhouse, France

[21] Appl. No.: 695,371

[22] Filed: Jan. 28, 1985

[30] Foreign Application Priority Data

Jan. 26, 1984 [FR] France ..... 84 01349

[51] Int. Cl.[4] ..... A62B 1/14; A63B 27/00

[52] U.S. Cl. ..... 188/65.1; 292/303; 182/5

[58] Field of Search ..... 188/67, 65.1, 65.2, 188/65.3; 49/255; 182/231–235, 5–7, 9; 292/303, DIG. 46, 80, 87; 220/331, 352, 356

[56] References Cited

U.S. PATENT DOCUMENTS

| | | | |
|---|---|---|---|
| 433,481 | 8/1890 | Mansfield | 188/65.5 |
| 1,621,047 | 3/1927 | Young | 49/255 |
| 2,086,534 | 7/1937 | Byrne | 220/331 |
| 2,157,639 | 5/1939 | Staggers | 188/65.1 |
| 3,165,225 | 1/1965 | Reitzel | 220/331 |
| 3,876,036 | 4/1975 | Sweet | 182/5 |
| 4,334,595 | 6/1982 | Koch | 182/5 |

FOREIGN PATENT DOCUMENTS

| | | | |
|---|---|---|---|
| 1941456 | 2/1971 | Fed. Rep. of Germany | 188/65.1 |
| 2370151 | 6/1978 | France . | |
| 2417988 | 9/1979 | France . | |
| 2437843 | 4/1980 | France . | |

*Primary Examiner*—George E. A. Halvosa
*Assistant Examiner*—James E. Barlow
*Attorney, Agent, or Firm*—Young & Thompson

[57] ABSTRACT

The present invention concerns an anti-falling device with rapid insertion and withdrawal of the retaining cord at any position of this latter. A cover is provided, on the side opposite its hinges (8), with lugs (9) coacting with recesses (10) of the corresponding wall of the case (1) for closing and opening the cover (6), which is slidably mounted on its hinges (8) so as to move the lugs (9) below the rim of the wall of the case (1) outside the position of the recesses (10), the cover (6) being adapted to be maintained in this position for releasing the lugs (9) by means of two locks (11) with sequential action coacting with the hinges (8).

5 Claims, 3 Drawing Figures

ANTI-FALLING DEVICE WITH RAPID INTRODUCTION AND WITHDRAWAL OF THE CORD IN ANY POSITION OF THIS LATTER

The present invention concerns the field of safety devices for workers subject to risks of falling, in particular from a great height, especially in the building industry and public works, and has as its object an anti-falling device with rapid introduction and withdrawal of the cord in any position of this latter.

At present, the existing anti-falling devices are generally constituted by a blocking mechanism joined to a body, which is attached to a harness or a belt worn by the user by means of a joining element such as a ring or the like, and by a retaining cord coacting with the blocking mechanism.

In these known anti-falling devices (FR-A-No.-2437843), the blocking mechanism is generally constituted by a series of rings traversed by the retaining cord and it is strictly necessary for positioning the cord to insert said cord in the rings, which is relatively long and cumbersome. Similarly, the disengagement of the cord from the blocking mechanism requires a reverse operation, whatever the length of the cord.

According to another known construction (FR-A-No.-2370151) the device is constituted by a body provided with a cover and blocking studs for the cord.

However, in such an embodiment, there is the risk of opening the cover inadvertently, as the latter does not provide any safety means.

In addition, in the case of working along a vertical construction such as a pole, the user requires a cord stretcher for regulating the cord slack.

The present invention has as its object to overcome these drawbacks.

In fact, it has as its object an anti-falling device with rapid introduction and withdrawal of the retaining cord, essentially comprised by a case having a lockable cover and containing a blocking mechanism coacting with a retaining cord, and by a handle for joining the case to a harness or a safety belt, characterized in that the cover is provided on its side opposite its hinges with lugs coacting with recesses of the corresponding case wall for opening and closing the cover which is slidably mounted on its hinges so as to move the lugs below the rim of the case wall outside the portion of the recesses, the cover being adapted to be retained in this position for depressing the lugs by means of two locks with sequential action coacting with the hinges.

The invention will be better understood thanks to the following description referring to a preferred embodiment given as a non-limiting example and explained with reference to the accompanying schematic drawings, in which.

Figure 1:
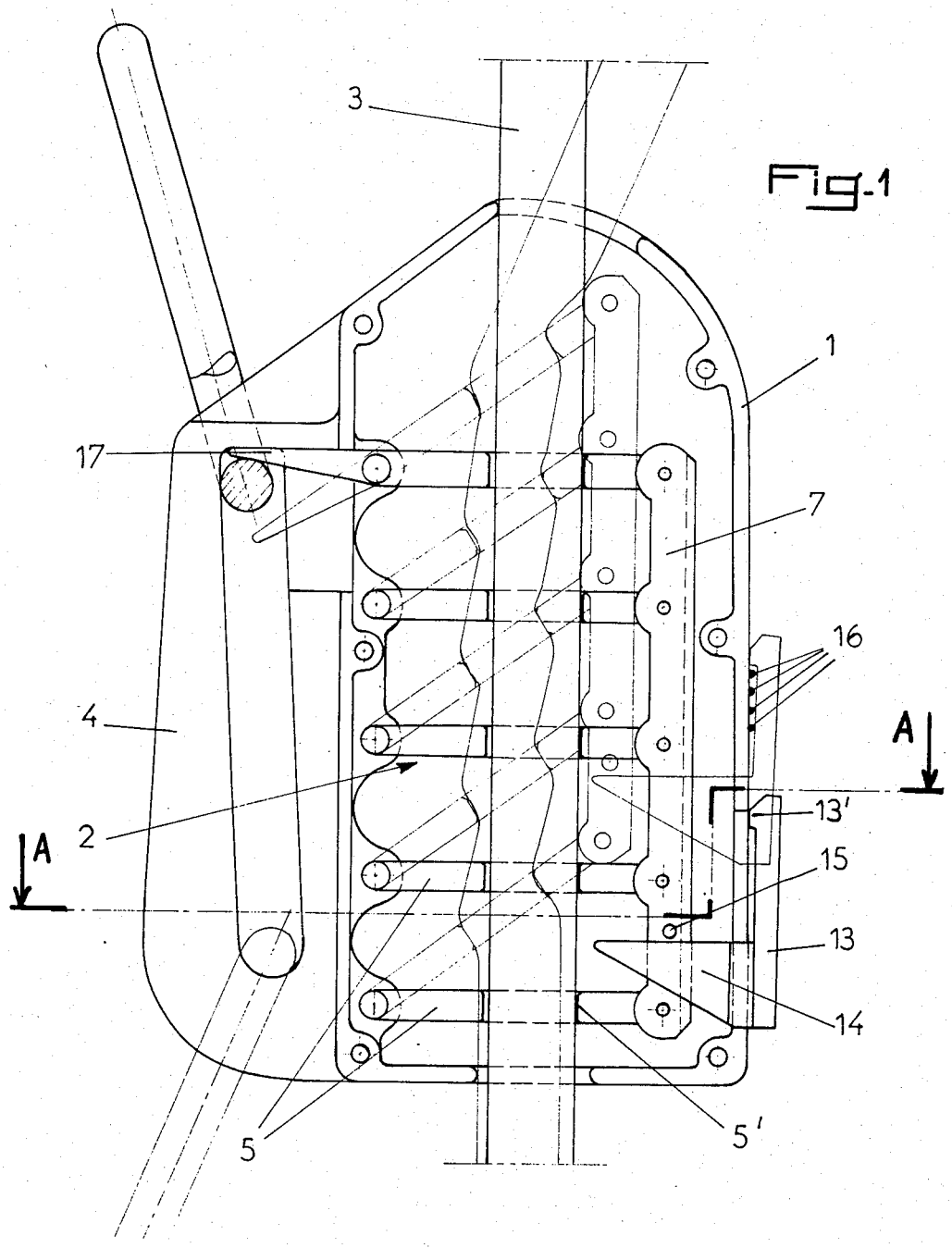
FIG. 1 is a side elevational view in section of an anti-falling device according to the invention.
Figure 2:
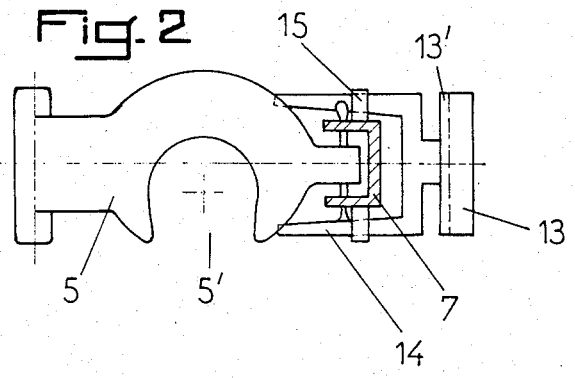
FIG. 2 is a plan view of a fork at the level of line A—A—.
Figure 3:
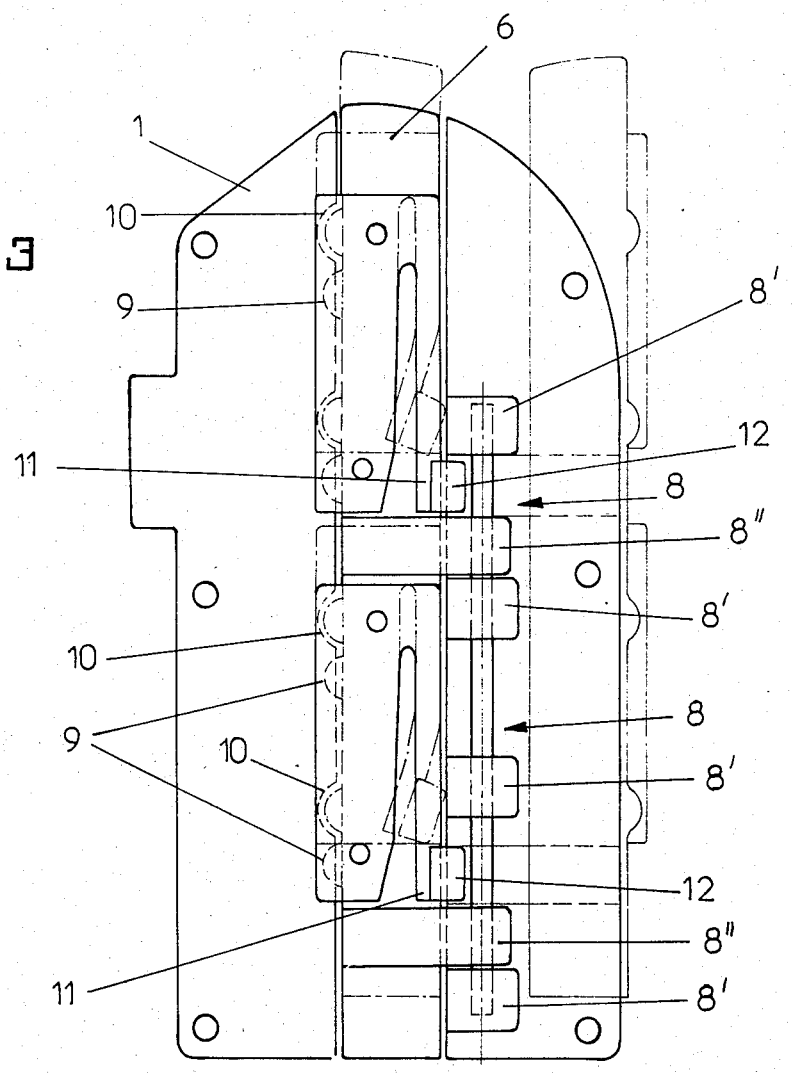
FIG. 3 is a side elevational view of the device according to FIG. 1.

According to the invention, and as shown in greater detail, as an example, in FIGS. 1 to 3 of the accompanying drawings, the anti-falling device with rapid introduction and withdrawal of the retaining cord, which is basically comprised by a case 1 having a lockable cover and containing a blocking mechanism 2 designed to coact with a retaining cord 3, and by a handle 4 allowing joining the case 1 to a harness or a safety belt, is characterized by the fact that the blocking mechanism 2 is constituted by a series of forks 5 having lateral openings 5'.

The forks 5 are pivotally mounted at one of their ends on the case 1 and are pivotally attached at their other end to a connecting arm 7.

The cover 6 is lockable and, on the side opposite its hinges 8, is provided with lugs 9 coacting with recesses 10 of the corresponding wall of the case 1 for opening and closing the cover 6, which is slidably mounted on its hinges 8, so as to displace the lugs 9 below the rim of the wall of the case 1 outside the position of the recesses 10, the cover 6 being adapted to be retained in this lowered position of the lugs 9 by means of two locks 11 having a sequential action and coacting with the hinges 8.

To this end, the hinges 8 have advantageously different spacings between stanchions 8' and hinges 8" and the locks 11 associated therewith are preferably elastically deformable means with a ratchet mechanism provided if needed with an operating button 12.

In this manner, starting from the closed position of the cover 6 (FIG. 3), the lock 11 associated with the hinge 8 having the shortest spacing between the stanchions and the hinge pin, that is, the hinge shown at the top in the figure, is pushed outside this space and the cover 6 can be moved upwards on the hinge axis until the lock 11 of the other hinge 8 abuts the upper stanchion of this other hinge. By unlocking this second lock 11 and subsequently moving the cover 6 upward until the hinge pin 8" of the top hinge is positioned in abutment with its corresponding stanchion 8' which is the shorter one, the lugs 9 are positioned in front of the recesses 10 (shown in dotted line in FIG. 3) and the cover 6 can be pivotally opened (fine line in FIG. 3) for positioning or withdrawing the cord 3 in or out the forks 5 of the mechanism 2.

The two locks 11 with sequential action allow ensuring a complete safety against an untimely opening of the cover 6, and therefore against an unwanted freeing of the cord 3.

According to another characteristic of the invention, on the side opposite the connecting handle 4, the anti-falling device is provided with a slider 13 guided on the case 1 for guided sliding and fitting in the latter by means of a fork 14 surrounding the connecting arm 7 of the forks 5, and each tongue of said fork supports a protrusion 15 joined to the arm 7 (FIG. 2). In this manner, it is possible for the user to block the anti-falling device on the cord 3 in the absence of a downward pull on the handle 4. This is particularly advantageous in the case of working on a pole, where the device has the function of a cord stretcher.

The slider 13 advantageously coacts with its beak-shaped upper part 13' with retention points 16, formed by casting, to ensure a better blocking of the cord 3 to the case 1.

To ensure maintenance of the blocking by means of the slider 13, the case 1 can be advantageously provided with a pivotable lock or a lock which can be elastically released, according to another embodiment of the invention, which is not shown. Such a lock can be slid into abutment with the lower rim of the slider 13 in blocking position, so as to prevent any unblocking of the mechanism 2 by unintentional action, manual or otherwise, that is, an action of the element for joining the case to the belt or the security harness on the lever 17 joined to the series of forks 5.

Thanks to the invention, it is possible to provide an anti-falling device allowing rapid and easy positioning and withdrawal of the retaining cord in any position of this latter thanks to the cover 6, and preventing any accidental opening of this cover. In addition, thanks to the slider 13, it is possible to block the device in a precise position of the cord, allowing the device to be used as a cord stretcher.

Obviously the invention is not limited to the described embodiment represented in the accompanying drawings. Modifications are possible, in particular from the point of view of the construction of the various elements or substitution with equivalent techniques without departing from the scope of the invention.

I claim:

1. In an anti-falling device adapted for rapid insertion and withdrawal of a retaining cord, comprising a case (1), a lockable cover means (6) on the case, a blocking mechanism (2) within the case which coacts with a retaining cord (3) selectively to block or release the cord, and means (4) for joining the case (1) to a security member; the improvement comprising lugs (9) on one side of the cover means (6), hinges (8) on a side of the cover means opposite the lugs (9), recesses (10) in a wall of the case (1), the cover means (6) being slidably mounted on said hinges (8) to move between a first position in which the lugs (9) register with the recesses (10) allowing the cover to open and a second position in which the lugs are out of registry with the recesses, two locks (11) for releasably maintaining the cover means in said second position thereby to maintain the cover means closed, said two locks being releasable sequentially upon sliding movement of the cover means from said second position toward said first position, and means for holding said locks, when released, open during movement of said cover means toward said first position such that one said lock (11) must be released and held open by the last-named means prior to the time that the other said lock is released and held open by the last-named means.

2. Apparatus as claimed in claim 1, in which said blocking mechanism (2) is constituted by a series of forks (5) with lateral openings (5') to receive said cord (3).

3. Apparatus as claimed in claim 1, said holding means comprising spaced stanchions (8') on the case (1), rod means extending between said stanchions, said hinges comprising hinge pins (8'') carried by the cover means and pivotally connected to said rod means, said locks comprising resilient detents that are disposed different distances from said stanchions whereby said one lock (11) comes into contact with and can be retained in an unlocked position by a said stanchion (8') at the same time that the other said lock is spaced from any said stanchion (8'), and whereby said other lock can be released and held released by a said stanchion only after said first lock has been released and held open by a stanchion and said cover means has moved toward said first position.

4. In an anti-falling device adapted for rapid insertion and withdrawal of a retaining cord, comprising a case (1), a lockable cover (6) on the case, a blocking mechanism (2) within the case which coacts with a retaining cord (3) selective to block or release the cord, and means (4) for joining the case (1) to a security member; the improvement in which said blockage mechanism (2) is a series of forks (5) with lateral openings (5') for receiving therein a said cord, said forks being pivotally mounted on the case at one end of the forks and pivotally joined to an arm (7) at the other end of the forks, protrusions (15) extending in opposite directions from said arm (7), a slider (13) slidably mounted on the case (1), a fork (14) carried by the slider, said fork having branches extending on both sides of said arm (7) and each branch of the last-mentioned fork (14) being adapted to contact a said protrusion (15) joined to the arm (7), whereupon sliding movement of the slider (13) causes said last-mentioned fork (14) to contact said protrusions (15) to move the device to a position to grip a said cord (3).

5. A device as claimed in claim 4, said slider (13) having a beak-shaped end (13'), and a retention formation (16) on said case (1) selectively engageable with said beak-shaped end (13') releasably to retain the first-mentioned forks (5) in any of a plurality of conjointly assumed swung positions.

* * * * *